US012669299B2

(12) United States Patent
Moriuchi et al.

(10) Patent No.: US 12,669,299 B2
(45) Date of Patent: Jun. 30, 2026

(54) METAL FIBER MOLDED BODY, TEMPERATURE REGULATION UNIT, AND METHOD FOR MANUFACTURING METAL FIBER MOLDED BODY

(71) Applicant: Tomoegawa Corporation, Tokyo (JP)

(72) Inventors: Hideki Moriuchi, Shizuoka (JP); Kazuki Ishihara, Shizuoka (JP); Kazuha Nishiura, Shizuoka (JP)

(73) Assignee: Tomoegawa Corporation, Tokyo (JP)

( * ) Notice: Subject to any disclaimer, the term of this patent is extended or adjusted under 35 U.S.C. 154(b) by 614 days.

(21) Appl. No.: 17/911,252

(22) PCT Filed: Feb. 9, 2021

(86) PCT No.: PCT/JP2021/004692
§ 371 (c)(1),
(2) Date: Sep. 13, 2022

(87) PCT Pub. No.: WO2021/192669
PCT Pub. Date: Sep. 30, 2021

(65) Prior Publication Data

US 2023/0105760 A1 Apr. 6, 2023

(30) Foreign Application Priority Data

Mar. 27, 2020 (JP) ..... 2020-058974

(51) Int. Cl.
*F28F 21/08* (2006.01)
*B22F 3/12* (2006.01)

(52) U.S. Cl.
CPC ..... *F28F 21/081* (2013.01); *B22F 3/12* (2013.01); *B22F 2304/15* (2013.01); *F28F 2255/18* (2013.01)

(58) Field of Classification Search
CPC ..... F28F 21/081; F28F 2255/18; B22F 3/12; D21H 13/48
See application file for complete search history.

(56) References Cited

U.S. PATENT DOCUMENTS 3,127,668 A 4/1964 Troy
6,110,417 A 8/2000 Sugikawa
(Continued)

FOREIGN PATENT DOCUMENTS

CN 1127433 A 7/1996
CN 102305564 A 4/2012
(Continued)

OTHER PUBLICATIONS

Translation JPH05156385A, Jun. 22, 1993.*
(Continued)

*Primary Examiner* — Jon T. Schermerhorn, Jr.
(74) *Attorney, Agent, or Firm* — Renner, Kenner, Greive, Bobak, Taylor & Weber

(57) ABSTRACT

In a metal fiber molded body (40), a ratio, to a presence ratio of metal fibers in a first cross-section, of a presence ratio of metal fibers in a second cross-section orthogonal to the first cross-section is in a range of 0.85 to 1.15. A method for manufacturing the metal fiber molded body (40) according to the present invention includes the steps of: accumulating a plurality of short metal fibers (30) on a receiving part; and sintering the plurality of short metal fibers (30) accumulated on the receiving part, to produce the metal fiber molded body (40).

9 Claims, 17 Drawing Sheets

(56) References Cited

U.S. PATENT DOCUMENTS

| | | | | |
|---|---|---|---|---|
| 6,965,513 | B2 * | 11/2005 | Montgomery | B82Y 10/00 257/E23.09 |
| 7,732,918 | B2 * | 6/2010 | Dangelo | H01L 23/373 257/E23.101 |
| 2006/0196640 | A1 * | 9/2006 | Siu | H01L 23/473 257/E23.103 |
| 2009/0269521 | A1 * | 10/2009 | Tuma | H01L 23/3733 427/383.1 |
| 2018/0128553 | A1 * | 5/2018 | Lewis | F28F 3/022 |
| 2020/0158447 | A1 | 5/2020 | Kaibuchi et al. | |
| 2020/0326135 | A1 * | 10/2020 | Uekubo | F28D 15/0233 |
| 2021/0022265 | A1 | 1/2021 | Inagaki et al. | |

FOREIGN PATENT DOCUMENTS

| | | | |
|---|---|---|---|
| CN | 104289717 | A | 1/2015 |
| CN | 106282852 | A | 1/2017 |
| JP | S5736495 | U | 8/1955 |
| JP | S4724327 | B | 7/1972 |
| JP | H02 175803 | A | 7/1990 |
| JP | H05156385 | A | 6/1993 |
| JP | 2001123386 | A | 5/2001 |
| JP | 2006049878 | | 2/2006 |
| WO | 2019022214 | A1 | 1/2019 |
| WO | 2020051752 | A1 | 3/2020 |
| WO | 2020054752 | A1 | 3/2020 |

OTHER PUBLICATIONS

International Search Report dated May 11, 2021 for PCT/JP2021/004692.

Taiwan Office Action issued Jul. 4, 2022 in Patent Application 110105524.

Korean Office Action dated Nov. 4, 2024.

CNSR for Application CN 2021800235344.

* cited by examiner

METAL FIBER MOLDED BODY, TEMPERATURE REGULATION UNIT, AND METHOD FOR MANUFACTURING METAL FIBER MOLDED BODY

TECHNICAL FIELD

The present invention relates to a metal fiber molded body formed from metal fibers, a temperature regulation unit including the metal fiber molded body, and a method for manufacturing the metal fiber molded body.

BACKGROUND ART

Hitherto, temperature regulation units have been used in electric equipment, electronic equipment, semiconductor equipment, etc., to protect circuits and other components that are sensitive to heat generation. More specifically, as the amount of power used by electric equipment or the like increases, the amount of heat generated also increases, and thus the internal temperature of the electric equipment or the like is regulated by cooling the generated heat with a temperature regulation unit. In such a temperature regulation unit, a metal fiber molded body formed from metal fibers is used in some cases.

As a method for manufacturing a metal fiber molded body, for example, methods disclosed in Japanese Laid-Open Patent Publication No. H6-279809 (JPH06-279809A), etc., are conventionally known. In the method for manufacturing a metal fiber molded body disclosed in Japanese Laid-Open Patent Publication No. H6-279809 (JPH06-279809A), a mold for molding is first immersed in a dispersion liquid containing metal fibers, then the metal fibers are attached by suction to a suction surface of the mold. Next, the mold is pulled up from the dispersion liquid while the metal fibers are attached by suction to the suction surface of the mold. Even after the mold is pulled up from the dispersion liquid, the metal fibers are still attached by suction to the suction surface of the mold. By repeating this operation many times, the metal fibers of a desired thickness are attached by suction to the suction surface of the mold. The metal fibers attached by suction to the suction surface of the mold are then sintered at a temperature that does not exceed the melting point of the metal fibers. Accordingly, a metal fiber molded body is produced.

In some cases, rather than a metal fiber molded body, a metal powder sintered body produced by sintering metal powder or metal bulk is used in a temperature regulation unit.

SUMMARY OF THE INVENTION

In the metal fiber molded body produced by the manufacturing method disclosed in Japanese Laid-Open Patent Publication No. H6-279809 (JPH06-279809A), the metal fibers are oriented mainly in a plane direction. Therefore, a temperature regulation unit having such a metal fiber molded body has a problem that the thermal conductivity along the plane where the metal fibers are oriented is excellent, but the thermal conductivity in a direction orthogonal to the plane where the metal fibers are oriented is inferior. Meanwhile, a temperature regulation unit having a metal powder sintered body produced by sintering metal powder or metal bulk has inferior elasticity when the temperature changes, as compared to the metal fiber molded body, so that, when a heat-transfer object to which the temperature regulation unit is attached expands or contracts, the temperature regulation unit cannot follow the expansion or contraction of the heat-transfer object, causing a problem that the temperature regulation unit becomes detached from the heat-transfer object or destroyed.

The present invention has been made in consideration of such circumstances, and an object of the present invention is to provide a metal fiber molded body having excellent thermal conductivity in any direction and having excellent elasticity when the temperature changes, a temperature regulation unit including the metal fiber molded body, and a method for manufacturing the metal fiber molded body.

Solution to the Problems

A metal fiber molded body of the present invention is a metal fiber molded body, wherein a ratio, to a presence ratio of metal fibers in a first cross-section, of a presence ratio of metal fibers in a second cross-section orthogonal to the first cross-section is in a range of 0.85 to 1.15.

A metal fiber molded body of the present invention is a metal fiber molded body produced by sintering a plurality of short metal fibers accumulated on a receiving part.

A temperature regulation unit of the present invention is a temperature regulation unit including: a metal fiber molded body produced by sintering a plurality of short metal fibers accumulated on a receiving part; and a support supporting the metal fiber molded body.

A method for manufacturing a metal fiber molded body of the present invention includes the steps of: accumulating a plurality of short metal fibers on a receiving part; and sintering the plurality of short metal fibers accumulated on the receiving part, to produce the metal fiber molded body.

DESCRIPTION OF THE PREFERRED EMBODIMENTS

Figure 1A:
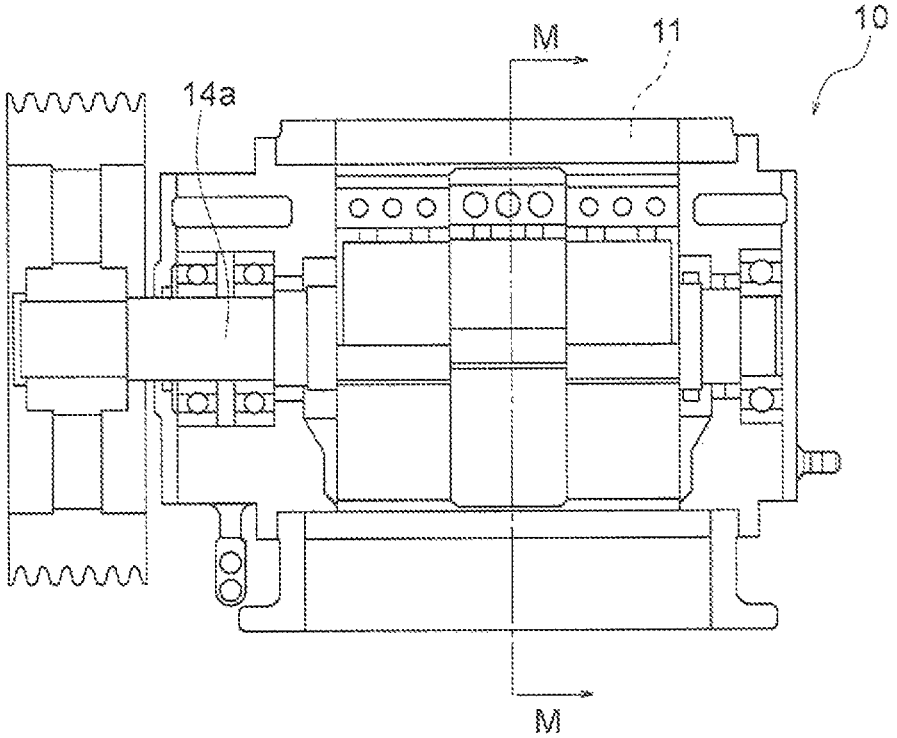
FIG. 1A is a side view showing the configuration of a cutter mill for physically impacting a plurality of short metal fibers.
Figure 1B:
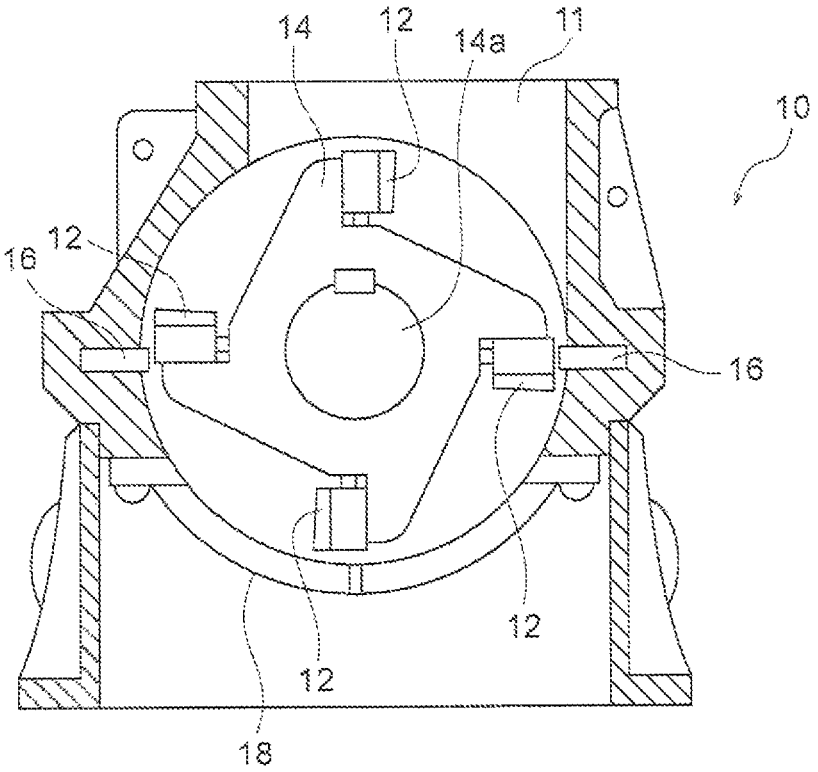
FIG. 1B is a cross-sectional view of the cutter mill shown in FIG. 1A, taken along a line M-M.
Figure 2:
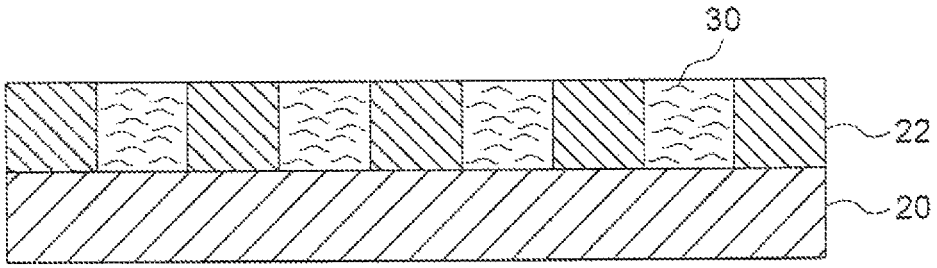
FIG. 2 is a diagram showing an operation of producing metal fiber molded bodies by sintering a plurality of short metal fibers accumulated on a receiving part.
Figure 3:
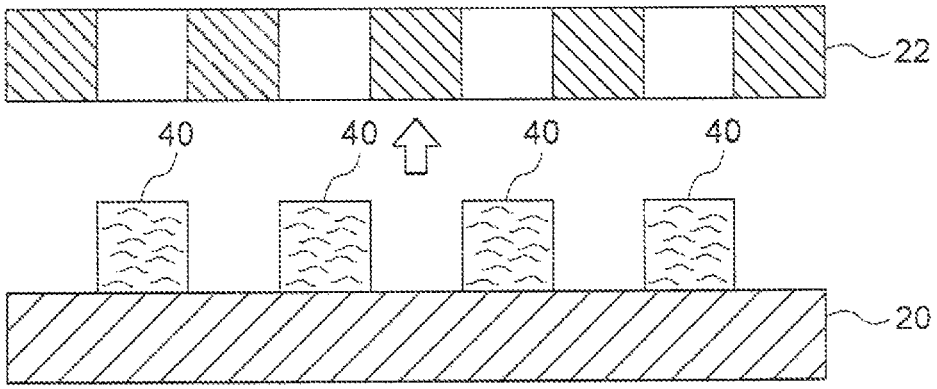
FIG. 3 is a diagram continuing from FIG. 2 and showing the operation of producing the metal fiber molded bodies by sintering the plurality of short metal fibers accumulated on the receiving part.
Figure 16:
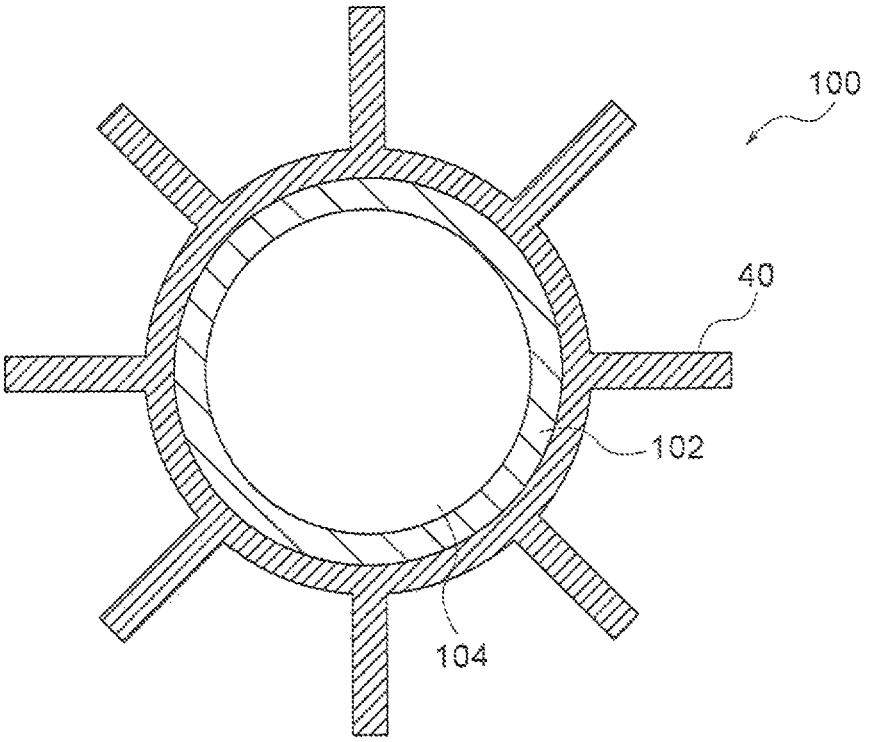
FIG. 16 is a cross-sectional view showing still another example of the temperature regulation unit including the metal fiber molded body according to the embodiment of the present invention.
Figure 17:
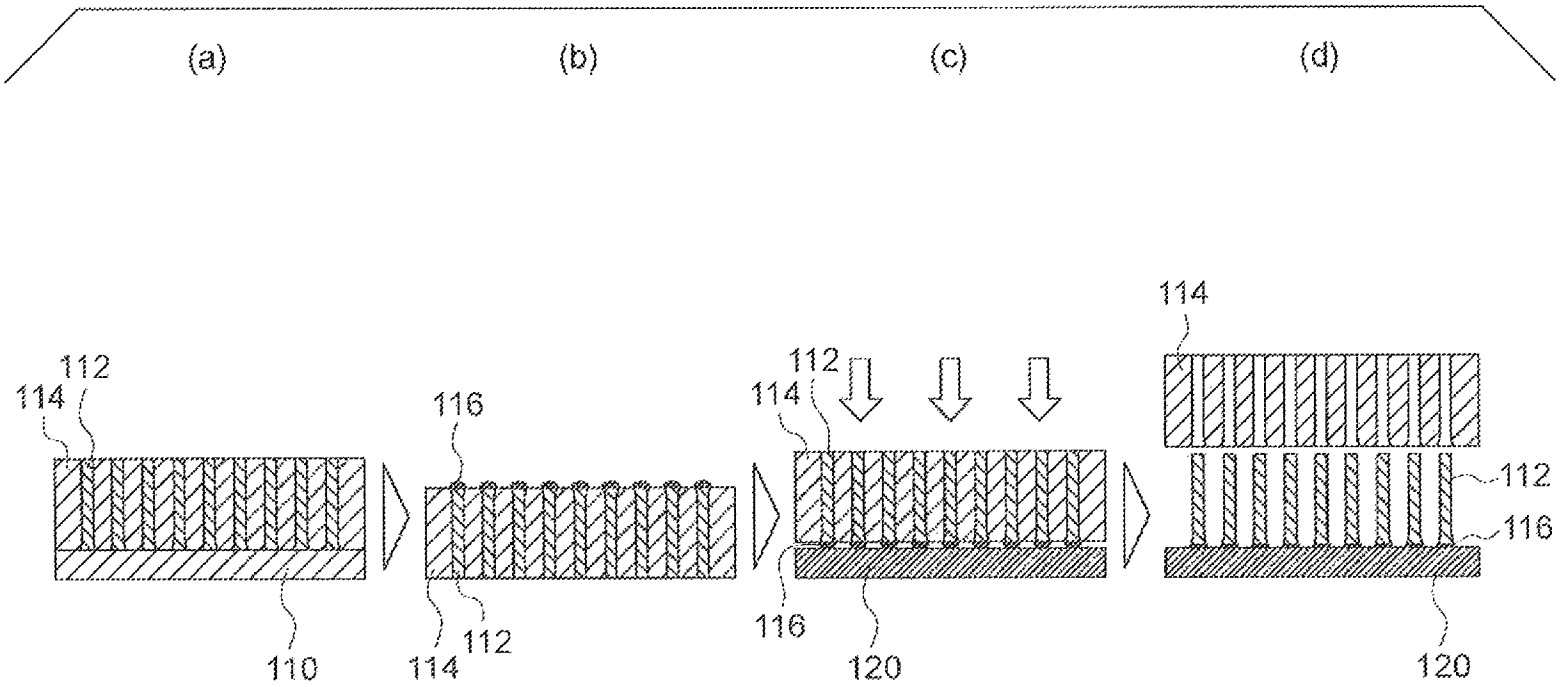
FIG. 17 is a diagram showing a modification of a method for manufacturing the temperature regulation unit including the metal fiber molded body according to the embodiment of the present invention.
Figure 18:
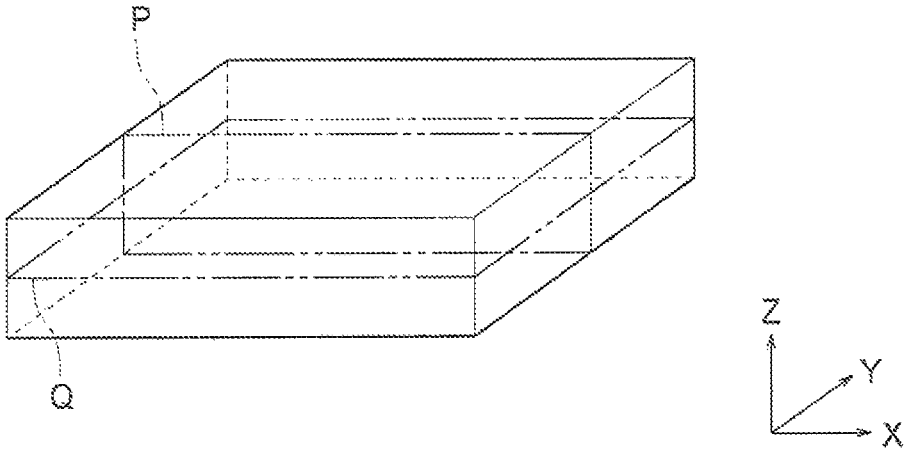
FIG. 18 is an explanatory diagram for showing cut surfaces of a metal fiber molded body or a metal molded body.

Hereinafter, an embodiment of the present invention will be described with reference to the drawings. FIG. 1A and FIG. 1B are diagrams showing the configuration of a cutter mill for physically impacting a plurality of short metal fibers. FIG. 2 and FIG. 3 are diagrams showing a method for manufacturing a metal fiber molded body according to the present embodiment. FIG. 4 to FIG. 16 are diagrams showing various configuration examples of a temperature regulation unit with the metal fiber molded body according to the present embodiment. FIG. 17 is a diagram showing a modification of a method for manufacturing the temperature regulation unit including the metal fiber molded body according to the present embodiment. FIG. 18 is an explanatory diagram for showing cut surfaces of a metal fiber molded body or a metal molded body, and FIG. 19 to FIG. 28 are cross-sectional views of metal fiber molded bodies and metal molded bodies according to examples and comparative examples.

First, the method for manufacturing the metal fiber molded body according to the present embodiment will be described with reference to FIG. 1A, FIG. 1B, FIG. 2, and FIG. 3. In the method for manufacturing the metal fiber molded body according to the present embodiment, a metal fiber molded body is formed by uniformly accumulating short metal fibers without using any medium such as water, and sintering the plurality of accumulated short metal fibers.

In more detail, first, a plurality of short metal fibers 30 are put into the inside of a cutter mill 10. The configuration of the cutter mill 10 will be described with reference to FIG. 1A and FIG. 1B. As shown in FIG. 1A and FIG. 2B, a rotor 14 having a plurality of (for example, four) rotary blades 12 mounted thereon is provided inside the cutter mill 10, and the rotor 14 is rotated about a shaft 14*a*. In addition, fixed blades 16 are provided at fixed positions around the rotor 14. Moreover, a screen 18 is provided below the rotor 14.

The plurality of short metal fibers 30 put into the inside of the cutter mill 10 through an upper opening 11 of the cutter mill 10 are ground by shearing between each fixed blade 16 and each rotary blade 12 which is mounted on the rotor 14 rotating about the shaft 14*a*. In addition, as the rotor 14 rotates, the plurality of short metal fibers 30 collide with each other inside the cutter mill 10, and the short metal fibers 30 and the fixed blades 16 or the rotary blades 12 collide with each other, whereby the short metal fibers 30 are worn and deformed. Specifically, the metal fibers 30 are bent or folded, whereby the surfaces of the short metal fibers 30 become smooth. In addition, such an operation can also remove burrs from the surfaces of the short metal fibers 30. The short metal fibers 30 sheared, worn, and deformed thus fall downward from the openings of the screen 18. Then, the short metal fibers 30 falling downward from the openings of the screen 18 are collected.

Other than the cutter mill 10, any device that can deform the short metal fibers 30 by physically impacting the short metal fibers 30 can be used. Examples of such a device include a stone-mill-shaped grinder (masscolloider) and a ball mill.

The short metal fibers 30 to be put into the inside of the cutter mill 10 are at least one type of fibers out of copper fibers, stainless steel fibers, nickel fibers, aluminum fibers, and alloy fibers thereof. In particular, copper fibers are preferably used as the short metal fibers 30. This is because copper fibers have an excellent balance between cost and rigidity, plastic deformability, and heat transfer properties. The lengths of the physically impacted short metal fibers 30 are preferably in the range of 0.01 to 1.00 mm, more preferably in the range of 0.05 to 0.50 mm, and further preferably in the range of 0.10 to 0.40 mm. The lengths of the short metal fibers 30 can be confirmed by actual measurement through photographic observation (SEM, optical microscope, etc.) of a metal fiber molded body 40. When the lengths of the short metal fibers 30 are 0.01 to 1.00 mm, it is easy to accumulate the short metal fibers 30 onto a receiving part, and the ratio, to the presence ratio of the metal fibers in a first cross-section, of the presence ratio of the metal fibers in a second cross-section orthogonal to the first cross-section in the metal fiber molded body 40 is easily made to be in the range of 0.85 to 1.15.

Then, the plurality of short metal fibers 30 physically impacted to be deformed fall downward from the openings of the screen 18 of the cutter mill 10. Then, the plurality of short metal fibers 30 falling downward from the openings of the screen 18 are accumulated on a graphite plate 20 (see FIG. 2). More specifically, a molding frame 22 having a plurality of through holes formed therein is placed on the graphite plate 20 in advance, and the plurality of short metal fibers 30 are put into the through holes of the molding frame 22. Accordingly, the plurality of short metal fibers 30 are accumulated inside the through holes of the molding frame 22 on the graphite plate 20. Then, the plurality of short metal fibers 30 are sintered in the state shown in FIG. 2, and pressed after sintering. Then, when the molding frame 22 is removed from the graphite plate 20 as shown in FIG. 3, metal fiber molded bodies 40 are formed on the graphite plate 20.

In each metal fiber molded body 40 manufactured by such a method, the ratio, to the presence ratio of the metal fibers in the first cross-section (for example, a cross-section P in FIG. 18), of the presence ratio of the metal fibers in the second cross-section (for example, a cross-section Q in FIG. 18) orthogonal to the first cross-section is in the range of 0.85 to 1.15. That is, as a result of accumulating the plurality of short metal fibers 30 on the receiving part such as the graphite plate 20 and then sintering the plurality of short metal fibers 30, the metal fibers are oriented not only in a plane direction but also in a direction orthogonal to the plane direction (that is, the thickness direction of the metal fiber molded body 40 (a Z direction in FIG. 18)) (see FIG. 19 to FIG. 22). In a metal fiber molded body obtained by immersing a mold for molding in a dispersion liquid containing metal fibers and attaching the metal fibers by suction to a suction surface of the mold as in the conventional art, the metal fibers are oriented mainly in the plane direction (see FIG. 23 and FIG. 24). Therefore, the ratio, to the presence ratio of the metal fibers in the first cross-section (for example, the cross-section P in FIG. 18), of the presence ratio of the metal fibers in the second cross-section (for example, the cross-section Q in FIG. 18) orthogonal to the first cross-section is less than 0.85 or greater than 1.15. Thus, in the metal fiber molded body 40 according to the present embodiment, the metal fibers are oriented not only in the plane direction (that is, an X direction and a Y direction in FIG. 18) but also in a direction (that is, the Z direction in FIG. 18) orthogonal to the plane direction, so that the metal fiber molded body 40 has excellent thermal conductivity in any direction. The properties, etc., of such a metal fiber molded body 40 will be described later.

Next, various configuration examples of a temperature regulation unit including such a metal fiber molded body 40 will be described with reference to FIG. 4 to FIG. 16. The temperature regulation unit including the metal fiber molded body according to the present embodiment is attached to a heat-transfer object such as a heat-generating electric or electronic component, thereby dissipating heat from the heat-transfer object.

First, a first configuration example of the temperature regulation unit will be described with reference to FIG. 4 and FIG. 5. A temperature regulation unit 50 shown in FIG. 4 and FIG. 5 has a frame-shaped exterior component 52 (support) and a plurality of metal fiber molded bodies 40 arranged in the internal space of the exterior component 52 so as to be spaced apart from each other. The exterior component 52 is formed from a material having heat transfer properties. In addition, the exterior component 52 is formed from a material that is impermeable to liquids and gases. Meanwhile, voids are formed between the metal fibers included in the metal fiber molded bodies 40, so that the metal fiber molded bodies 40 allow liquids and gases to pass therethrough. As shown in FIG. 5, one having a columnar shape is used as each metal fiber molded body 40. In addition, each metal fiber molded body 40 having a columnar shape is arranged on each intersection point of grid lines. Moreover, a space 54 through which a fluid passes is formed between each metal fiber molded body 40. By causing a liquid refrigerant to flow through such a space 54, heat can be dissipated from a heat-transfer object such as an electric component or an electronic component to which the temperature regulation unit 50 is attached. In addition, as another application of the temperature regulation unit 50, by causing a high-temperature fluid, which is to be cooled, to flow through the space 54, heat may be dissipated from the fluid flowing through the space 54.

Figure 4:
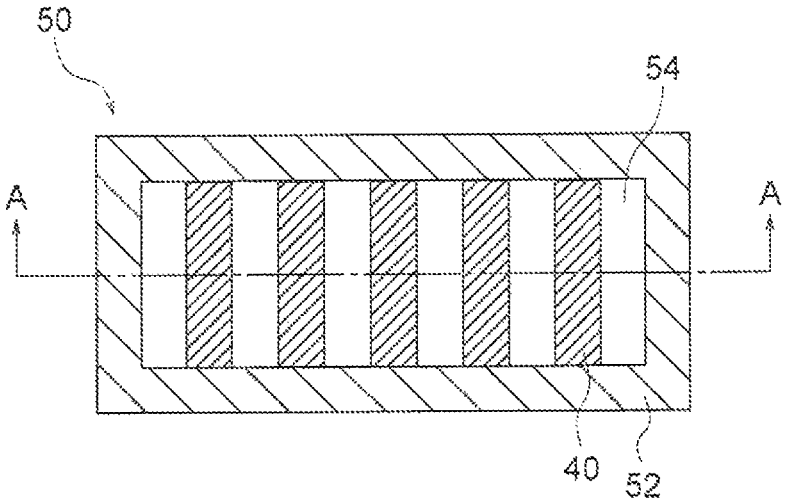
FIG. 4 is a cross-sectional view showing an example of the configuration of a temperature regulation unit including a metal fiber molded body according to an embodiment of the present invention.
Figure 5:
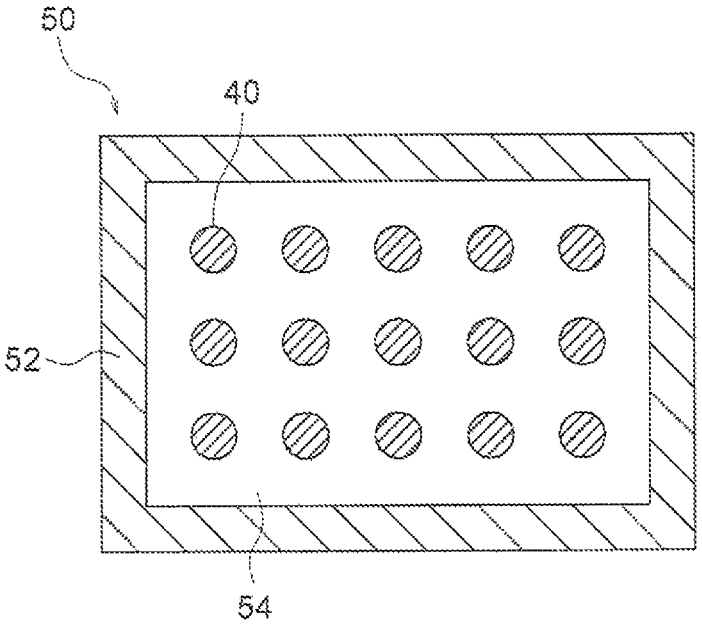
FIG. 5 is a cross-sectional view of the temperature regulation unit shown in FIG. 4, taken along a line A-A.

Moreover, plating may be performed on the surface of the exterior component 52 of the temperature regulation unit 50 shown in FIG. 4 and FIG. 5, for example, by thermal spraying. Alternatively, final polishing or grinding of the surface of the exterior component 52 may be performed. Still alternatively, the surface of the exterior component 52 may be embedded in resin. If these treatments are performed, the surface of the exterior component 52 is protected, so that wear, etc., of the exterior component 52 can be suppressed.

Figure 6:
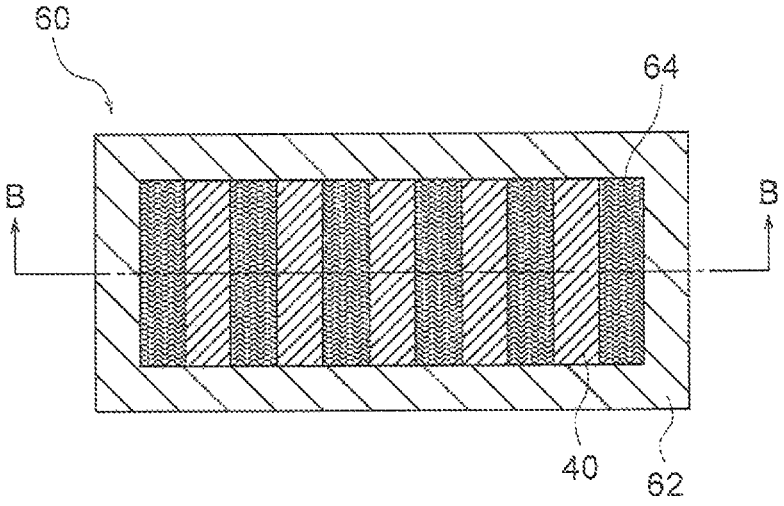
FIG. 6 is a cross-sectional view showing another example of the configuration of the temperature regulation unit including the metal fiber molded body according to the embodiment of the present invention.
Figure 7:
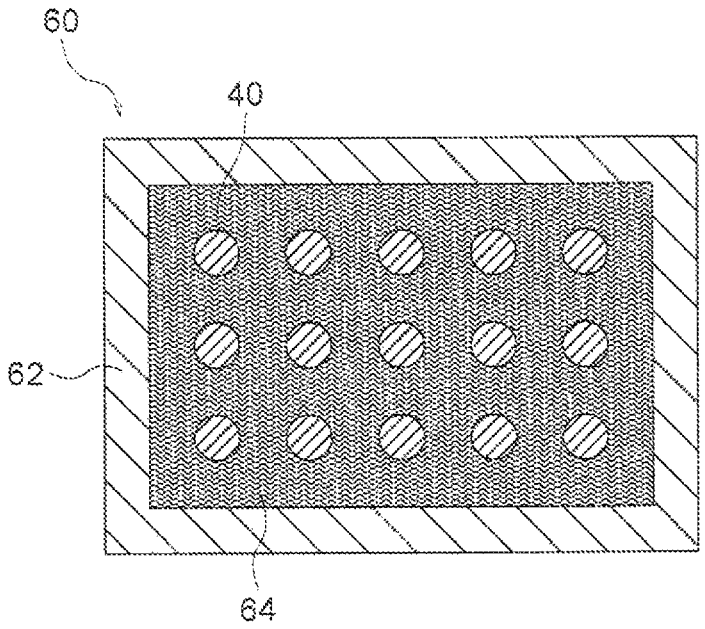
FIG. 7 is a cross-sectional view of the temperature regulation unit shown in FIG. 6, taken along a line B-B.

Next, a second configuration example of the temperature regulation unit will be described with reference to FIG. 6 and FIG. 7. A temperature regulation unit 60 shown in FIG. 6 and FIG. 7 has a frame-shaped exterior component 62 (support), a plurality of metal fiber molded bodies 40 arranged in the internal space of the exterior component 62 so as to be spaced apart from each other, and a conventional metal fiber molded body 64 disposed in the space between each metal fiber molded body 40. The conventional metal fiber molded body 64 is manufactured by a method described below. First, a fibrous material such as metal fibers is dispersed in water or the like to prepare a paper-making slurry. The water is filtered from the paper-making slurry to obtain a wet sheet. The wet sheet is further dehydrated. The dehydrated sheet is dried to obtain a dry sheet. Then, the dry sheet is bound at a temperature that does not exceed the melting point of the metal fibers. Accordingly, the conventional metal fiber molded body 64 is produced. Such a conventional metal fiber molded body 64 has substantially the same properties as a metal fiber molded body according to a first comparative example described later.

The exterior component 62 is formed from a material having heat transfer properties. In addition, the exterior component 62 is formed from a material that is impermeable to liquids and gases. Meanwhile, voids are formed between the metal fibers included in the metal fiber molded bodies 40 and the conventional metal fiber molded body 64, so that the metal fiber molded bodies 40 and the conventional metal fiber molded body 64 allow liquids and gases to pass therethrough. As shown in FIG. 7, one having a columnar shape is used as each metal fiber molded body 40. In addition, each metal fiber molded body 40 having a columnar shape is arranged on each intersection point of grid lines. Moreover, since the conventional metal fiber molded body 64 is disposed between each metal fiber molded body 40, there is no space inside the exterior component 62. Such a temperature regulation unit 60 can also be attached to a heat-transfer object such as an electric component or an electronic component, thereby dissipating heat from the heat-transfer object. By changing the densities of the metal fiber molded bodies 40 and the metal fiber molded body 64, the ease of passage of a medium such as a liquid or gas can also be controlled. Preferably, the density of the metal fiber molded bodies 64 is lower than the density of each metal fiber molded body 40.

Figure 8:
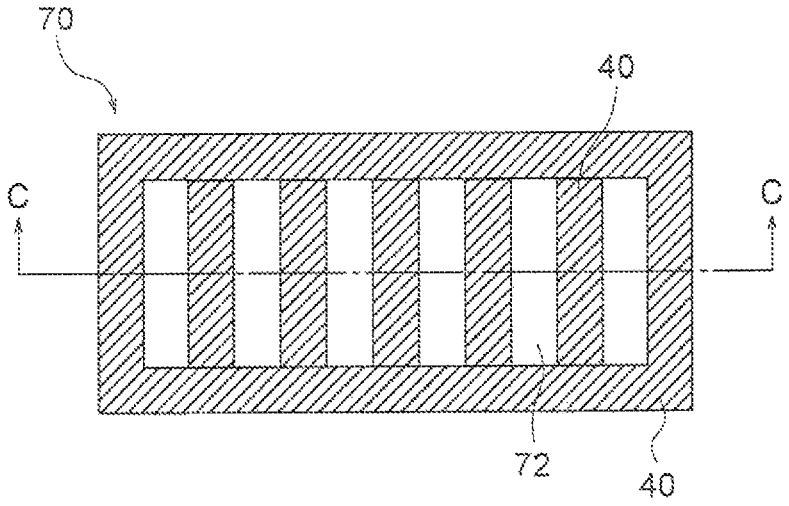
FIG. 8 is a cross-sectional view showing still another example of the temperature regulation unit including the metal fiber molded body according to the embodiment of the present invention.
Figure 9:
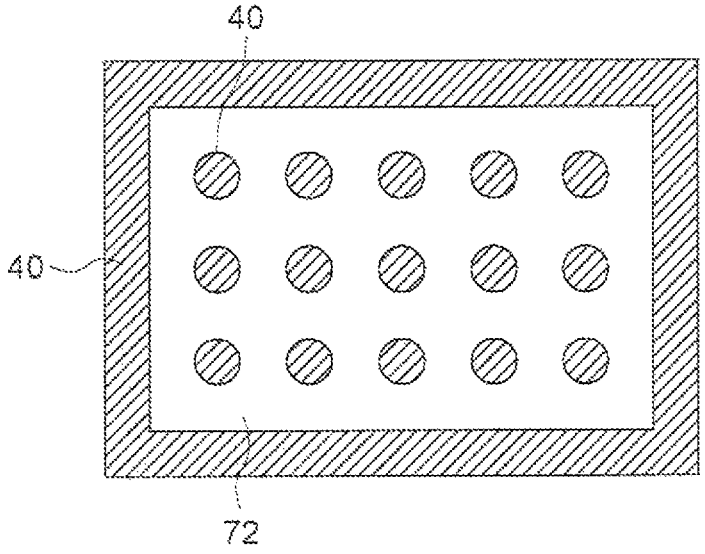
FIG. 9 is a cross-sectional view of the temperature regulation unit shown in FIG. 8, taken along a line C-C.

Next, a third configuration example of the temperature regulation unit will be described with reference to FIG. 8 and FIG. 9. A temperature regulation unit 70 shown in FIG. 8 and FIG. 9 has a frame-shaped metal fiber molded body 40 and a plurality of metal fiber molded bodies 40 arranged in the internal space of the frame-shaped metal fiber molded body 40 so as to be spaced apart from each other. As each metal fiber molded body 40 arranged in the internal space of the frame-shaped metal fiber molded body 40, one having a columnar shape is used. In addition, each metal fiber molded body 40 having a columnar shape is arranged on each intersection point of grid lines. As described above, voids are formed between the metal fibers included in the metal fiber molded bodies 40, so that the metal fiber molded bodies 40 allow liquids and gases to pass therethrough. Moreover, a space 72 through which a fluid passes is formed between each metal fiber molded body 40 having a columnar shape. Voids are formed in the frame-shaped metal fiber molded body 40, so that the frame-shaped metal fiber molded body 40 allows liquids to pass therethrough. Therefore, when a liquid is caused to flow through the space 72, liquid leakage may occur. Therefore, the fluid flowing through the space 72 is preferably a gas. Such a temperature regulation unit 70 can also be attached to a heat-transfer object such as an electric component or an electronic component, thereby dissipating heat from the heat-transfer object.

Figure 10:
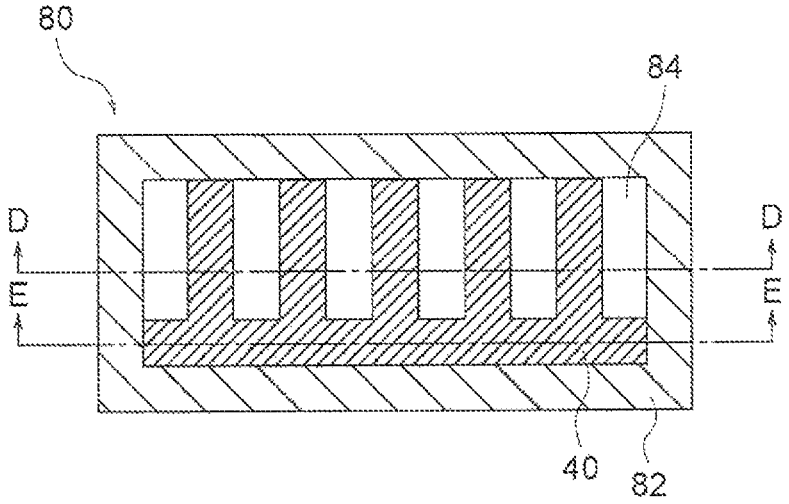
FIG. 10 is a cross-sectional view showing still another example of the temperature regulation unit including the metal fiber molded body according to the embodiment of the present invention.
Figure 11:
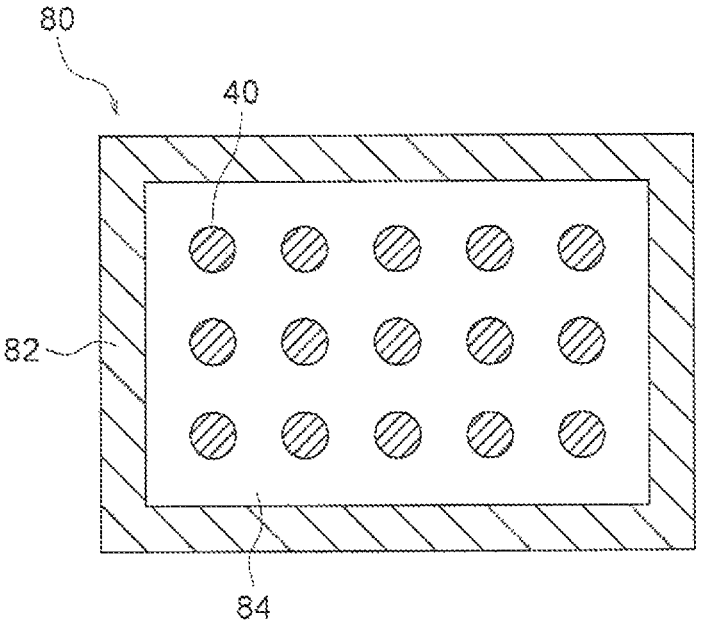
FIG. 11 is a cross-sectional view of the temperature regulation unit shown in FIG. 10, taken along a line D-D.
Figure 12:
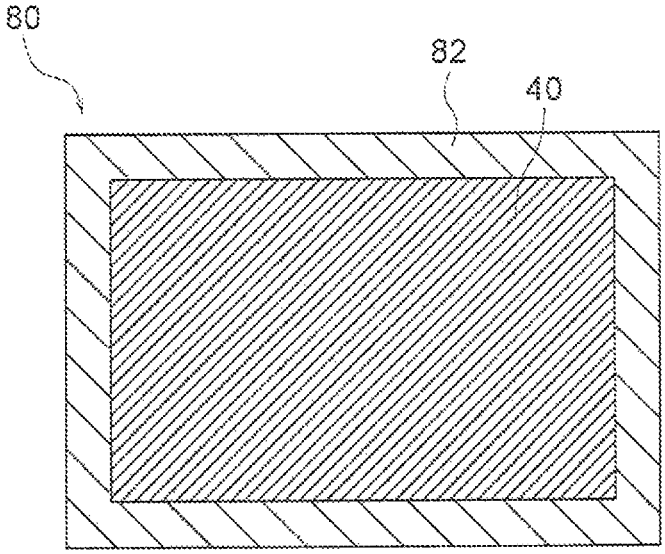
FIG. 12 is a cross-sectional view of the temperature regulation unit shown in FIG. 10, taken along a line E-E.

Next, a fourth configuration example of the temperature regulation unit will be described with reference to FIG. 10 to FIG. 12. A temperature regulation unit 80 shown in FIG. 10 to FIG. 12 has a frame-shaped exterior component 82 (support), a plurality of metal fiber molded bodies 40 (see FIG. 11) arranged in the internal space of the exterior component 82 so as to be spaced apart from each other, and a flat-plate-shaped metal fiber molded body 40 (see FIG. 12) for connecting each metal fiber molded body 40. The exterior component 82 is formed from a material having heat transfer properties. In addition, the exterior component 82 is formed from a material that is impermeable to liquids and gases. Meanwhile, voids are formed between the metal fibers included in the metal fiber molded bodies 40, so that the metal fiber molded bodies 40 allow liquids and gases to pass therethrough. As shown in FIG. 11, one having a columnar shape is used as each of the metal fiber molded bodies 40 arranged in the internal space of the exterior component 82 so as to be spaced apart from each other. In addition, each metal fiber molded body 40 having a columnar shape is arranged on each intersection point of grid lines. Moreover, a space 84 through which a fluid passes is formed between each metal fiber molded body 40. By causing a liquid refrigerant to flow through such a space 84, heat can be dissipated from a heat-transfer object such as an electric component or an electronic component to which the temperature regulation unit 80 is attached. In addition, as another application of the temperature regulation unit 80, by causing a high-temperature fluid, which is to be cooled, to flow through the space 84, heat may be dissipated from the fluid flowing through the space 84.

Figure 13:
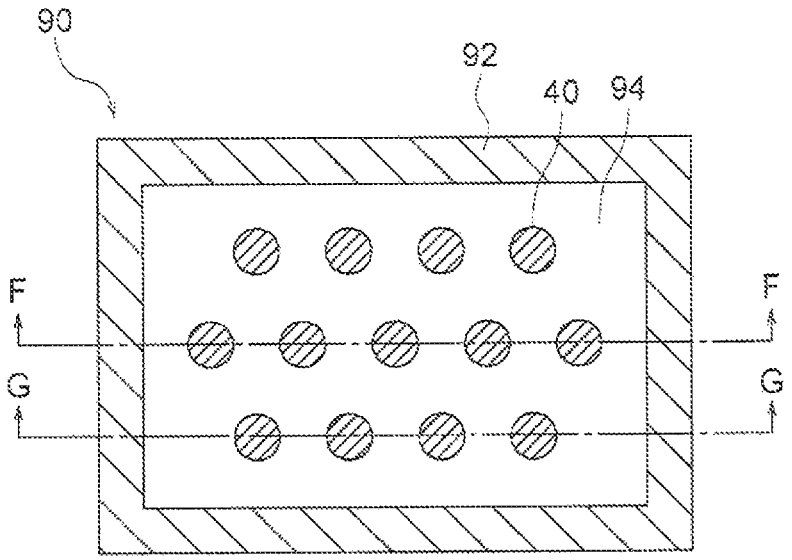
FIG. 13 is a cross-sectional view showing still another example of the temperature regulation unit including the metal fiber molded body according to the embodiment of the present invention.
Figure 14:
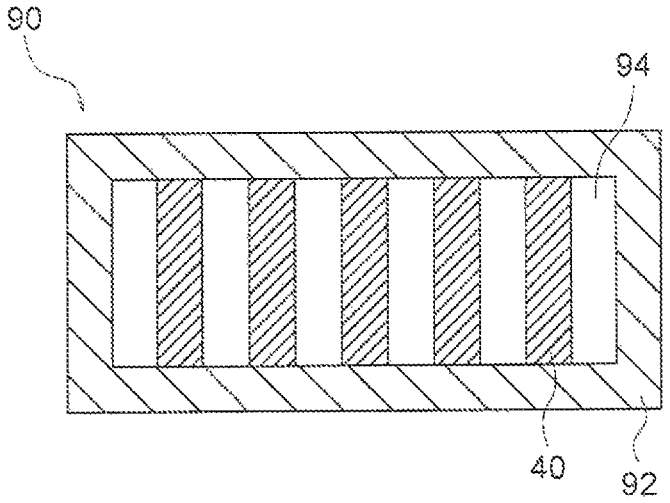
FIG. 14 is a cross-sectional view of the temperature regulation unit shown in FIG. 13, taken along a line F-F.
Figure 15:
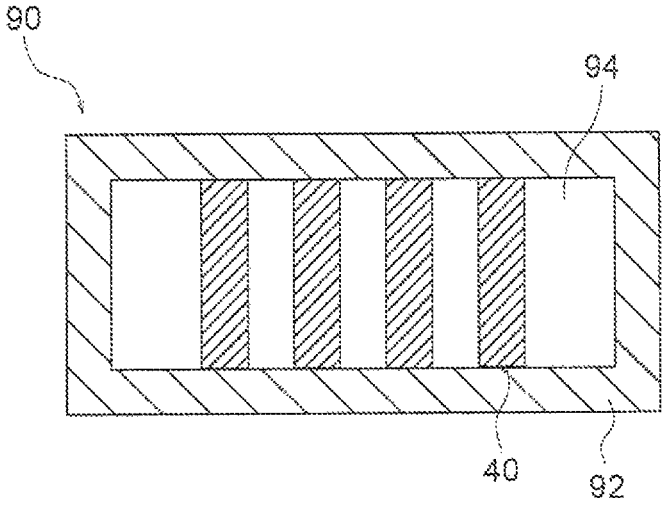
FIG. 15 is a cross-sectional view of the temperature regulation unit shown in FIG. 13, taken along a line G-G.

Next, a fifth configuration example of the temperature regulation unit will be described with reference to FIG. 13 to FIG. 15. A temperature regulation unit 90 shown in FIG. 13 to FIG. 15 has a frame-shaped exterior component 92 (support) and a plurality of metal fiber molded bodies 40 arranged in the internal space of the exterior component 92 so as to be spaced apart from each other. The exterior component 92 is formed from a material having heat transfer properties. In addition, the exterior component 92 is formed from a material that is impermeable to liquids and gases. Meanwhile, voids are formed between the metal fibers included in the metal fiber molded bodies 40, so that the metal fiber molded bodies 40 allow liquids and gases to pass therethrough. As shown in FIG. 13, one having a columnar shape is used as each metal fiber molded body 40. In the temperature regulation unit 90 shown in FIG. 13 to FIG. 15, each metal fiber molded body 40 having a columnar shape is not arranged on each intersection point of grid lines. Moreover, a space 94 through which a fluid passes is formed between each metal fiber molded body 40. By causing a liquid refrigerant to flow through such a space 94, heat can be dissipated from a heat-transfer object such as an electric component or an electronic component to which the temperature regulation unit 90 is attached. In addition, as another application of the temperature regulation unit 90, by causing a high-temperature fluid, which is to be cooled, to flow through the space 94, heat may be dissipated from the fluid flowing through the space 94.

Next, a sixth configuration example of the temperature regulation unit will be described with reference to FIG. 16. A temperature regulation unit 100 shown in FIG. 16 is obtained by bending and wrapping a plate-shaped metal fiber molded body 40 (support) on the outer circumferential surface of a copper pipe 102 used as a heat-transfer object, and further brazing fin-shaped metal fiber molded bodies 40 to the bent plate-shaped metal fiber molded body 40. At this time, since the metal fiber molded body 40 contains a plurality of short metal fibers 30, the metal fiber molded body 40 is flexible, and thus can be bent along a curved surface that is the outer circumferential surface of the pipe 102, so that a gap can be inhibited from being formed between the metal fiber molded body 40 and the pipe 102. Therefore, sufficient heat transfer properties can be maintained. With such a temperature regulation unit 100, a high-temperature medium passing through an internal region 104 of the pipe 102 can be cooled. In addition, when a refrigerant is caused to flow through the internal region 104 of the pipe 102, the environment surrounding the temperature regulation unit 100 can be cooled by removing heat from the environment.

Next, a method for producing a fin-shaped temperature regulation unit will be described with reference to FIG. 17. First, a plurality of short metal fibers 30 physically impacted by the cutter mill 10 or the like to be deformed are accumulated on a graphite plate 110 (see FIG. 17(*a*)). More specifically, a molding frame 114 having a plurality of through holes formed therein is placed on the graphite plate 110 in advance, and the plurality of short metal fibers 30 are put into the through holes of the molding frame 114. Accordingly, the plurality of short metal fibers 30 are accumulated inside the through holes of the molding frame 114 on the graphite plate 110. Then, the plurality of short metal fibers 30 are sintered in the state shown in FIG. 17(*a*), and pressed after sintering. Accordingly, a metal fiber molded body 112 is formed inside each through hole of the molding frame 114. Then, the graphite plate 110 is removed, and nanosilver 116 is printed on an end portion of each metal fiber molded body 112. Then, as shown in FIG. 17(*c*), the surface, of the molding frame 114, on the side on which the nanosilver 116 is printed on each metal fiber molded body 112 is brought into contact with the surface of a substrate 120. Then, post-wetting treatment (treatment of evenly applying a thinner to the upper surface of the molding frame 114 shown in FIG. 17(*c*)) is performed on the molding frame 114 having the metal fiber molded body 112 formed inside each through hole thereof, and heating and sintering are then performed, for example, at 300° C. At this time, the molding frame 114 is pressed against the substrate 120. Accordingly, each metal fiber molded body 112 is bonded to the substrate 120 by the nanosilver 116. Then, the molding frame 114 is removed as shown in FIG. 17(*d*). Accordingly, the substrate 120 having a plurality of the fin-shaped metal fiber molded bodies 112 mounted thereon is obtained. Such a combination of the substrate 120 and the plurality of the fin-shaped metal fiber molded bodies 112 is also used as a temperature regulation unit.

The metal fiber molded body 40 configured as described above and produced by sintering the plurality of short metal fibers 30 accumulated on the receiving part (specifically, the graphite plate 20) has excellent thermal conductivity in any direction, and also has excellent elasticity when the temperature changes. More specifically, in the metal fiber molded body obtained by immersing a mold for molding in a dispersion liquid containing metal fibers and attaching the metal fibers by suction to a suction surface of the mold as in the conventional art, the metal fibers are oriented mainly in the plane direction, so that a temperature regulation unit having such a metal fiber molded body has excellent thermal conductivity along the plane where the metal fibers are oriented, but has inferior thermal conductivity in a direction orthogonal to the plane where the metal fibers are oriented. On the other hand, as for the metal fiber molded body 40 of the present embodiment, the plurality of short metal fibers 30 are accumulated on the receiving part such as the graphite plate 20 and then sintered, whereby the metal fibers are oriented not only in the plane direction but also in a direction (that is, the thickness direction of the metal fiber molded body 40) orthogonal to the plane direction. Therefore, the thermal conductivity becomes excellent in any direction. In addition, since the metal fiber molded body 40 contains the metal fibers, gaps are formed inside the metal fiber molded body 40. Therefore, the metal fiber molded body 40 has better elasticity than a metal powder sintered body or metal bulk produced by sintering metal powder.

EXAMPLES

Hereinafter, the present invention will be described in more detail by means of examples and comparative examples.

First Example 1 kg of short copper fibers having an average fiber length of 0.114 mm and an average fiber diameter of 0.021 mm was put into a cutter mill (manufactured by Horai Co., Ltd.: BO-360 model), and the short copper fibers were processed using a 0.5 mm screen. Next, the short copper fibers taken out of the cutter mill were accumulated on a high-purity alumina plate (manufactured by KYOCERA Corporation). More specifically, a molding frame having a plurality of through holes (5 mm in length, 5 mm in width, 500 μm in height) formed therein was placed on the high-purity alumina plate in advance, and the short copper fibers were put into the through holes of the molding frame. Accordingly, the short copper fibers were accumulated inside the through holes of the molding frame on the high-purity alumina plate. Then, the high-purity alumina plate having the short copper fibers accumulated inside the through holes of the molding frame thereon was put into a vacuum sintering furnace (manufactured by CHUGAI RO CO., LTD.), and sintered in this vacuum sintering furnace under nitrogen gas at a pressure of 10 Torr and a sintering temperature of 1000° C. for 2 hours. Then, the sintered bodies were taken out of the molding frame, a spacer was placed to achieve a desired thickness, and the sintered bodies were pressed at a pressure of 100 kN. The metal fiber molded bodies produced as described above had a thickness of 415 μm and a basis weight of 300 g/m2.

Figure 19:
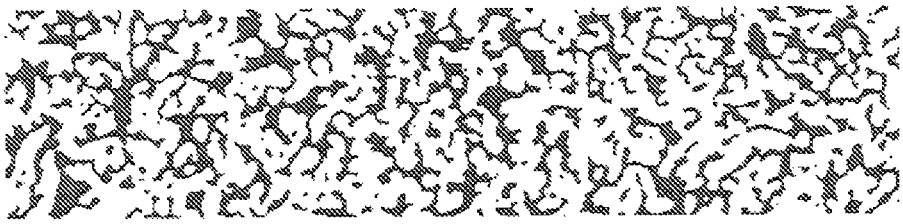
FIG. 19 is a photograph showing a cut surface when a metal fiber molded body according to a first example was cut at a cross-section P in FIG. 18.
Figure 20:
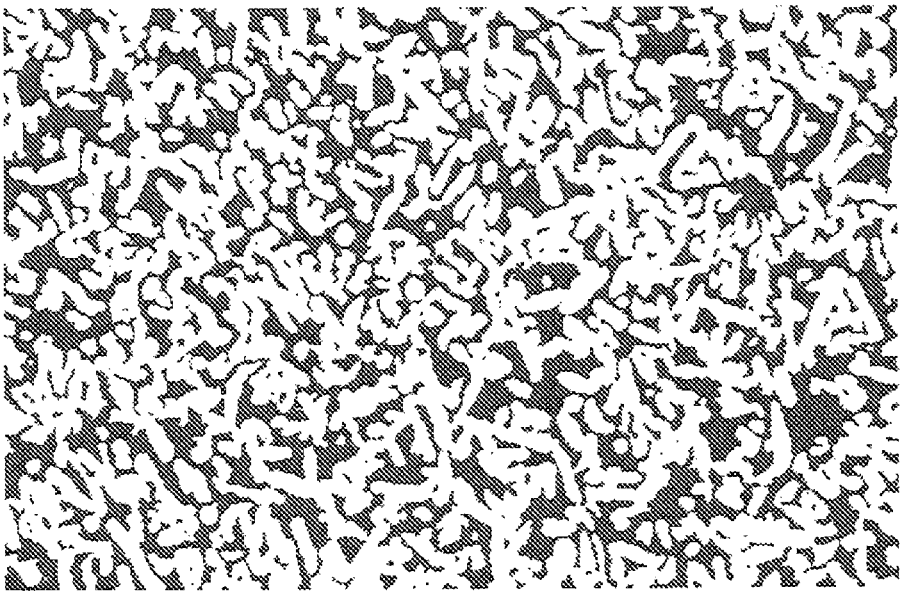
FIG. 20 is a photograph showing a cut surface when the metal fiber molded body according to the first example was cut at a cross-section Q in FIG. 18.

The cut surface when the metal fiber molded body according to the first example was cut at the cross-section P in FIG. 18 was as shown in a photograph in FIG. 19. In addition, the cut surface when the metal fiber molded body according to the first example was cut at the cross-section Q in FIG. 18 was as shown in a photograph in FIG. 20. These photographs were taken by a scanning electron microscope (SEM) manufactured by NIKON CORPORATION. In FIG. 19 and FIG. 20, the white portions indicate portions where the metal fibers are present, and the black portions indicate voids between the metal fibers. As shown in FIG. 19 and FIG. 20, in the metal fiber molded body according to the first example, the metal fibers are oriented not only in a plane direction (that is, the X direction and the Y direction in FIG. 18) but also in a direction (that is, the Z direction in FIG. 18) orthogonal to the plane direction. Here, the presence ratio of the metal fibers in the cross-section shown in FIG. 19 was 0.672, and the presence ratio of the metal fibers in the cross-section shown in FIG. 20 was 0.626. Therefore, the ratio, to the presence ratio of the metal fibers in the first cross-section (cross-section shown in FIG. 19), of the presence ratio of the metal fiber in the second cross-section (cross-section shown in FIG. 20) orthogonal to the first cross-section was 0.931.

Second Example 1 kg of short copper fibers having an average fiber length of 0.085 mm and an average fiber diameter of 0.037 mm was put into a cutter mill (manufactured by Horai Co., Ltd.: BO-360 model), and the short copper fibers were processed using a 0.5 mm screen. Next, the short copper fibers taken out of the cutter mill were accumulated on a high-purity alumina plate (manufactured by KYOCERA Corporation). More specifically, a molding frame having a plurality of through holes (5 mm in length, 5 mm in width, 500 μm in height) formed therein was placed on the high-purity alumina plate in advance, and the short copper fibers were put into the through holes of the molding frame. Accordingly, the short copper fibers were accumulated inside the through holes of the molding frame on the high-purity alumina plate. Then, the high-purity alumina plate having the short copper fibers accumulated inside the through holes of the molding frame thereon was put into a vacuum sintering furnace (manufactured by CHUGAI RO CO., LTD.), and sintered in this vacuum sintering furnace under nitrogen gas at a pressure of 10 Torr and a sintering temperature of 1000° C.

for 2 hours. Then, the sintered bodies were taken out of the molding frame, a spacer was placed to achieve a desired thickness, and the sintered bodies were pressed at a pressure of 100 kN. The metal fiber molded bodies produced as described above had a thickness of 204 μm and a basis weight of 1000 g/m2. The metal fiber molded bodies according to the second example are denser than the metal fiber molded bodies according to the first example.

Figure 21:
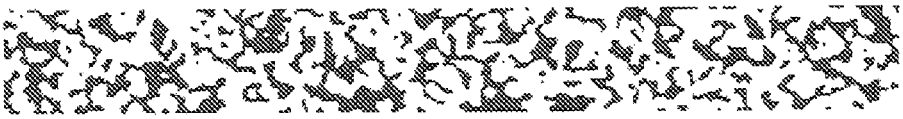
FIG. 21 is a photograph showing a cut surface when a metal fiber molded body according to a second example was cut at the cross-section P in FIG. 18.
Figure 22:
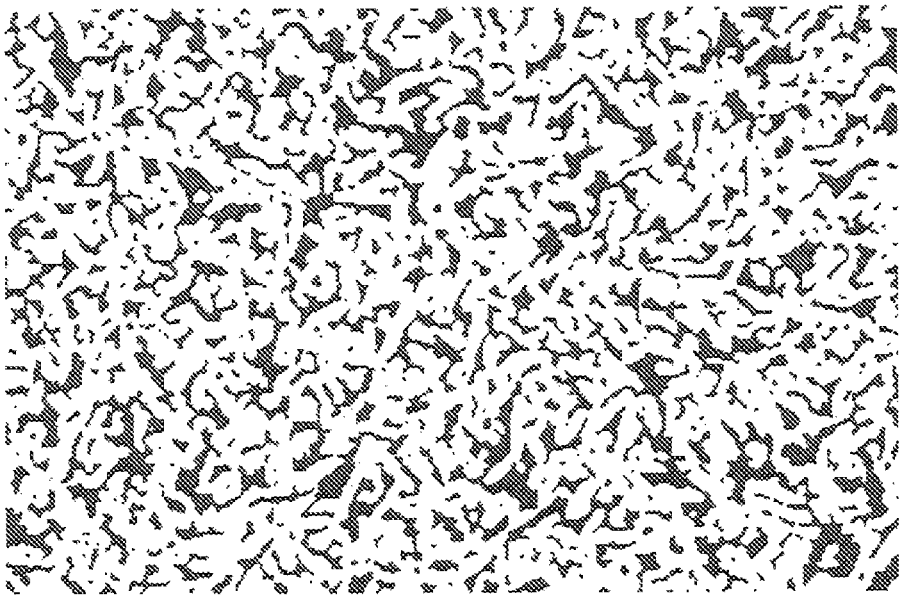
FIG. 22 is a photograph showing a cut surface when the metal fiber molded body according to the second example was cut at the cross-section Q in FIG. 18.

The cut surface when the metal fiber molded body according to the second example was cut at the cross-section P in FIG. 18 was as shown in a photograph in FIG. 21. In addition, the cut surface when the metal fiber molded body according to the second example was cut at the cross-section Q in FIG. 18 was as shown in a photograph in FIG. 22. These photographs were taken by a scanning electron microscope (SEM) manufactured by NIKON CORPORATION. In FIG. 21 and FIG. 22, the white portions indicate portions where the metal fibers are present, and the black portions indicate voids between the metal fibers. As shown in FIG. 21 and FIG. 22, in the metal fiber molded body according to the second example, the metal fibers are oriented not only in a plane direction (that is, the X direction and the Y direction in FIG. 18) but also in a direction (that is, the Z direction in FIG. 18) orthogonal to the plane direction. Here, the presence ratio of the metal fibers in the cross-section shown in FIG. 21 was 0.651, and the presence ratio of the metal fibers in the cross-section shown in FIG. 22 was 0.730. Therefore, the ratio, to the presence ratio of the metal fibers in the first cross-section (cross-section shown in FIG. 21), of the presence ratio of the metal fiber in the second cross-section (cross-section shown in FIG. 22) orthogonal to the first cross-section was 1.121.

Third to Sixth Examples

Metal fiber molded bodies of third to sixth examples were produced in the same manner as the first example, except that short copper fibers having an average fiber length and an average fiber diameter shown in Table 1 were used and the size of each through hole of the high-purity alumina plate was changed as appropriate. Each physical property value is as shown in Table 1.

First Comparative Example 3 g of short copper fibers having an average fiber length of 2.875 mm and a fiber diameter of 0.019 mm and 11 g of PVA fibers (trade name: "Fibribond VPB105-1", manufactured by Kuraray Co., Ltd.) which has a dissolution temperature in water of 70° C. were put into water such that the concentration thereof was 2%, 0.33 g of a nonionic surfactant (trade name: Desgran B, manufactured by DAIWA CHEMICAL INDUSTRIES CO., LTD.) was added to the mixture, and the mixture was agitated for dispersion. This dispersion liquid was put into a container having a diameter of 60 cm and a volume of 120 liters, and 1.5 liters of a paper-making polyacrylamide-based dispersing viscous agent solution (solid concentration: 0.08%, trade name "ACRYPERSE PMP", manufactured by Mitsubishi Chemical Corporation) was further added, water was further added to make 100 liters, and the mixture was agitated for dispersion, to prepare a paper-making slurry. The paper-making slurry was put into a molding mold (5 cm in diameter, 15 cm in length) having a 120-mesh wire net wrapped therearound, and was dehydrated while being sucked with a vacuum pump, to obtain a wet sheet. Then, the wet sheet was put into a dryer at a temperature of 100° C. and dried for 120 minutes. The dried sheet was sintered in a vacuum sintering furnace under nitrogen gas at a pressure of 10 Torr and a sintering temperature of 1000° C. for 2 hours. Then, the sintered bodies were taken out, a spacer was placed to achieve a desired thickness, and the sintered bodies were pressed at a pressure of 100 kN. The metal fiber molded bodies produced as described above had a thickness of 145 μm and a basis weight of 299 g/m2.

Figure 23:
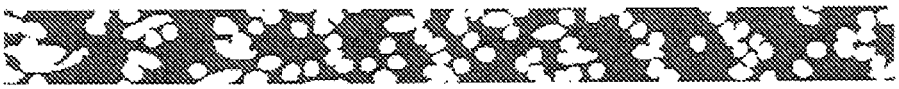
FIG. 23 is a photograph showing a cut surface when a conventional metal fiber molded body according to a first comparative example was cut at the cross-section P in FIG. 18.
Figure 24:
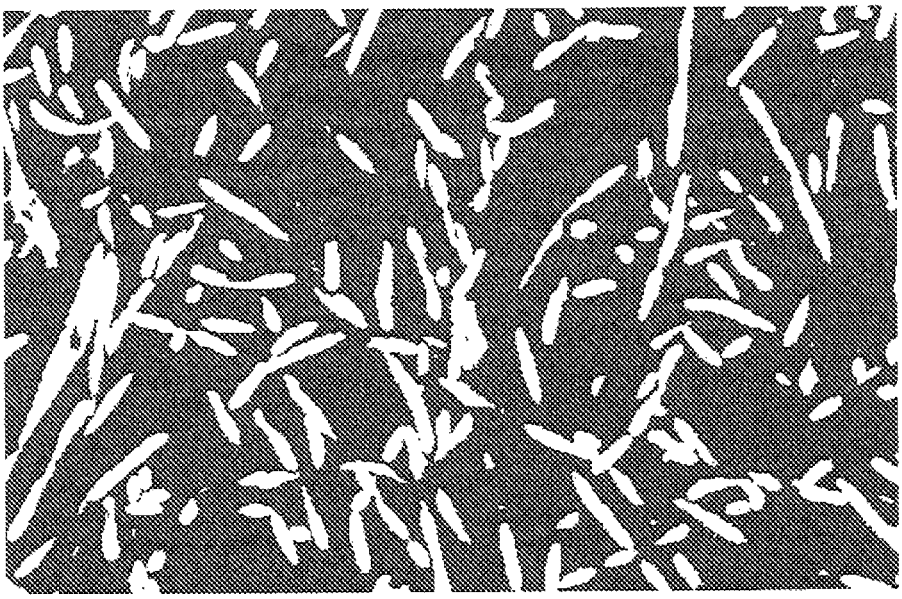
FIG. 24 is a photograph showing a cut surface when the conventional metal fiber molded body according to the first comparative example was cut at the cross-section Q in FIG. 18.

The cut surface when the metal fiber molded body according to the first comparative example was cut at the cross-section P in FIG. 18 was as shown in a photograph in FIG. 23. In addition, the cut surface when the metal fiber molded body according to the first comparative example was cut at the cross-section Q in FIG. 18 was as shown in a photograph in FIG. 24. These photographs were taken by a scanning electron microscope (SEM) manufactured by NIKON CORPORATION. In FIG. 23 and FIG. 24, the white portions indicate portions where the metal fibers are present, and the black portions indicate voids between the metal fibers. As shown in FIG. 23 and FIG. 24, in the metal fiber molded body according to the first comparative example, the metal fibers are oriented mainly in a plane direction (that is, the X direction and the Y direction in FIG. 18), but not so much oriented in a direction (that is, the Z direction in FIG. 18) orthogonal to the plane direction. Here, the presence ratio of the metal fibers in the cross-section shown in FIG. 23 was 0.363, and the presence ratio of the metal fibers in the cross-section shown in FIG. 24 was 0.225. Therefore, the ratio, to the presence ratio of the metal fibers in the first cross-section (cross-section shown in FIG. 23), of the presence ratio of the metal fiber in the second cross-section (cross-section shown in FIG. 24) orthogonal to the first cross-section was 0.620.

Second Comparative Example

Spherical copper powder having an average diameter of 0.040 mm was accumulated on a high-purity alumina plate (manufactured by KYOCERA Corporation). More specifically, a molding frame having a plurality of through holes (5 mm in length, 5 mm in width, 500 μm in height) formed therein was placed on the high-purity alumina plate in advance, and the copper powder was put into the through holes of the molding frame. Accordingly, the copper powder was accumulated inside the through holes of the molding frame on the high-purity alumina plate. Then, the high-purity alumina plate having the copper powder accumulated inside the through holes of the molding frame thereon was put into a vacuum sintering furnace (manufactured by CHUGAI RO CO., LTD.), and sintered in this vacuum sintering furnace under nitrogen gas at a pressure of 10 Torr and a sintering temperature of 1000° C. for 2 hours. Then, the sintered bodies were taken out of the molding frame. The metal molded bodies made of copper and produced as described above had a thickness of 494 μm and a basis weight of 3403 g/m2. Accordingly, the metal molded bodies made of copper were manufactured.

Figure 25:
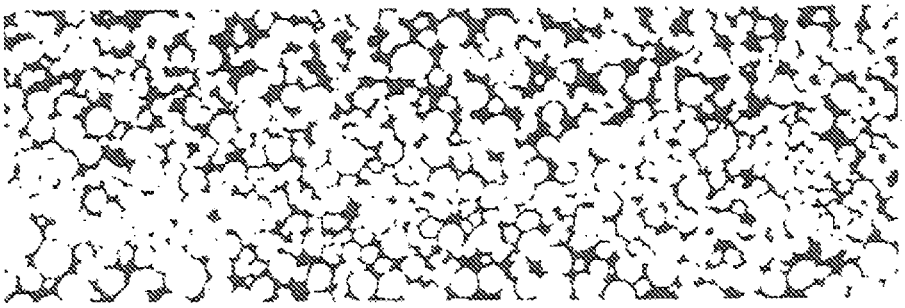
FIG. 25 is a photograph showing a cut surface when a conventional metal fiber molded body according to a second comparative example was cut at the cross-section P in FIG. 18.
Figure 26:
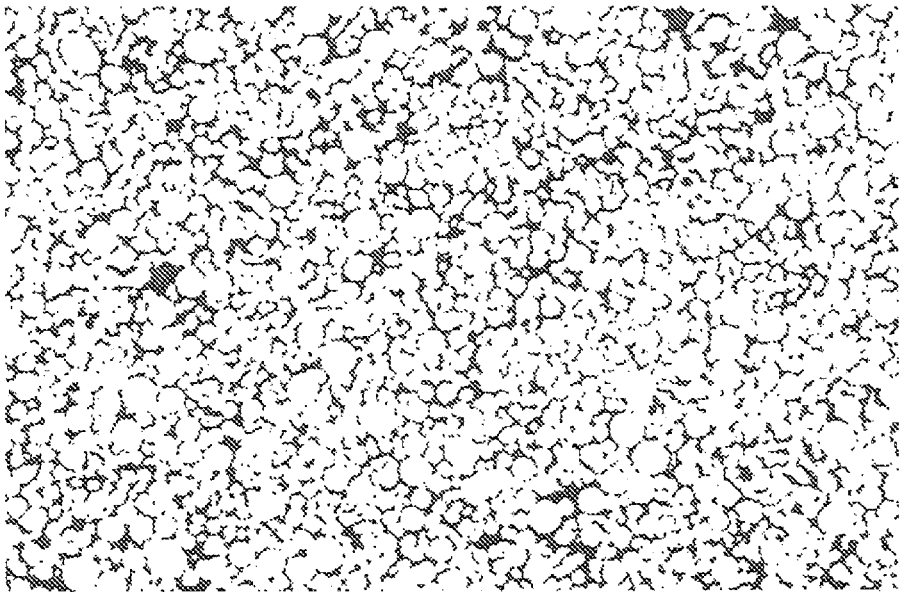
FIG. 26 is a photograph showing a cut surface when the conventional metal fiber molded body according to the second comparative example was cut at the cross-section Q in FIG. 18.

The cut surface when the metal molded body made of copper according to the second comparative example was cut at the cross-section P in FIG. 18 was as shown in a photograph in FIG. 25. In addition, the cut surface when the metal molded body made of copper according to the second comparative example was cut at the cross-section Q in FIG. 18 was as shown in a photograph in FIG. 26. These photographs were taken by a scanning electron microscope (SEM) manufactured by NIKON CORPORATION. In FIG. 25 and FIG. 26, the white portions indicate portions where the metal is present, and the black portions indicate voids between the metals. The presence ratio of the metal in the cross-section shown in FIG. 25 was 0.759, and the presence ratio of the metal in the cross-section shown in FIG. 26 was 0.804. Therefore, the ratio, to the presence ratio of the metal in the first cross-section (cross-section shown in FIG. 25), of the presence ratio of the metal in the second cross-section (cross-section shown in FIG. 26) orthogonal to the first cross-section was 1.060.

Third Comparative Example

Irregular-shaped copper powder (manufactured by MITSUI MINING & SMELTING CO., LTD.: MA-CC (average particle diameter: 40 μm)) was accumulated on a high-purity alumina plate (manufactured by KYOCERA Corporation). More specifically, a molding frame having a plurality of through holes (5 mm in length, 5 mm in width, 500 μm in height) formed therein was placed on the high-purity alumina plate in advance, and the irregular-shaped copper powder was put into the through holes of the molding frame. Accordingly, the irregular-shaped copper powder was accumulated inside the through holes of the molding frame on the high-purity alumina plate. Then, the high-purity alumina plate having the irregular-shaped copper powder accumulated inside the through holes of the molding frame thereon was put into a vacuum sintering furnace (manufactured by CHUGAI RO CO., LTD.), and sintered in this vacuum sintering furnace under nitrogen gas at a pressure of 10 Torr and a sintering temperature of 1000° C. for 2 hours. Then, the sintered bodies were taken out of the molding frame. The metal molded bodies made of copper and produced as described above had a thickness of 315 μm and a basis weight of 2066 g/m2. Accordingly, the metal molded bodies made of copper were manufactured.

Figure 27:
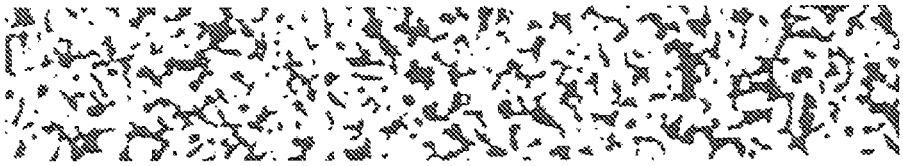
FIG. 27 is a photograph showing a cut surface when a conventional metal fiber molded body according to a third comparative example was cut at the cross-section P in FIG. 18.
Figure 28:
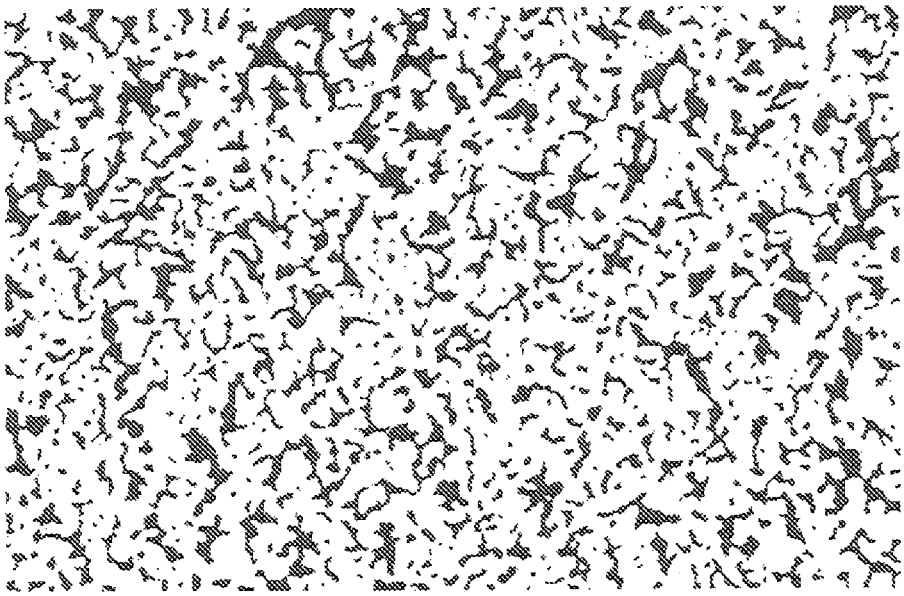
FIG. 28 is a photograph showing a cut surface when the conventional metal fiber molded body according to the third comparative example was cut at the cross-section Q in FIG. 18.

The cut surface when the metal fiber molded body according to the third comparative example was cut at the cross-section P in FIG. 18 was as shown in a photograph in FIG. 27. In addition, the cut surface when the metal fiber molded body according to the third comparative example was cut at the cross-section Q in FIG. 18 was as shown in a photograph in FIG. 28. These photographs were taken by a scanning electron microscope (SEM) manufactured by NIKON CORPORATION. In FIG. 27 and FIG. 28, the white portions indicate portions where the metal is present, and the black portions indicate voids between the metals. The presence ratio of the metal in the cross-section shown in FIG. 27 was 0.725, and the presence ratio of the metal in the cross-section shown in FIG. 28 was 0.756. Therefore, the ratio, to the presence ratio of the metal in the first cross-section (cross-section shown in FIG. 27), of the presence ratio of the metal in the second cross-section (cross-section shown in FIG. 28) orthogonal to the first cross-section was 1.043.

Fourth Comparative Example

A copper sheet having a thickness of 1004 μm was used as a metal according to a fourth comparative example. Each physical property value is as shown in Table 2.

Fifth Comparative Example

Metal fiber molded bodies of a fifth comparative example were produced in the same manner as the first comparative example, except that short copper fibers having an average fiber length and an average fiber diameter shown in Table 2 were used and the size of each through hole of the high-purity alumina plate was changed as appropriate. Each physical property value is as shown in Table 2.

Sixth Comparative Example

Metal fiber molded bodies of a sixth comparative example were produced in the same manner as the first comparative example, except that short copper fibers having an average fiber length and an average fiber diameter shown in Table 2 were used, the size of each through hole of the high-purity alumina plate was changed as appropriate, and agitation was not performed when preparing the dispersion liquid. Each physical property value is as shown in Table 2.

Seventh Comparative Example 3 g of short copper fibers having an average fiber length of 0.210 mm and a fiber diameter of 0.003 mm and 11 g of PVA fibers (trade name: "Fibribond VPB105-1", manufactured by Kuraray Co., Ltd.) which has a dissolution temperature in water of 70° C. were put into water such that the concentration thereof was 2%, 0.33 g of a nonionic surfactant (trade name: Desgran B, manufactured by DAIWA CHEMICAL INDUSTRIES CO., LTD.) was added to the mixture, and the mixture was agitated for dispersion. This dispersion liquid was put into a container having a diameter of 60 cm and a volume of 120 liters, and 1.5 liters of a paper-making polyacrylamide-based dispersing viscous agent solution (solid concentration: 0.08%, trade name "ACRYPERSE PMP", manufactured by Mitsubishi Chemical Corporation) was further added, water was further added to make 100 liters, and the mixture was agitated for dispersion, to prepare a paper-making slurry. The paper-making slurry was put into a molding mold (5 cm in diameter, 15 cm in length) having a 120-mesh wire net wrapped therearound, and was dehydrated while being sucked with a vacuum pump, to obtain a wet sheet. Then, the wet sheet was put into a dryer at a temperature of 100° C. and dried for 120 minutes to obtain a dry sheet. The dry sheet was impregnated with a slurry in which magnesium oxide particles were dispersed in water, was put into a dryer at a temperature of 100° C., and was dried for 120 minutes. The dried sheet was sintered in a vacuum sintering furnace under nitrogen gas at a pressure of 10 Torr and a sintering temperature of 1000° C. for 2 hours. Then, the sintered bodies were taken out, were immersed in dilute hydrochloric acid to dissolve and remove the magnesium oxide particles, and were then washed. Then, a spacer was placed to achieve a desired thickness, and the sintered bodies were pressed at a pressure of 100 kN. The metal fiber molded bodies produced as described above had a thickness of 296 μm and a basis weight of 1307 g/m2. Each physical property value is as shown in Table 2.

<Evaluation>

The metal fiber molded bodies according to the first to sixth examples, the metal fiber molded bodies according to the first comparative example and the fifth to seventh comparative examples, the metal molded bodies (metal powder sintered bodies) according to the second comparative example and the third comparative example, and the metal body (metal bulk) according to the fourth comparative example were examined for ratio of metal presence ratios, thickness, space factor, thermal conductivity, elongation percentage, CTE relaxation properties, and air permeability. The results of the examinations are shown in Tables 1 and 2 below.

TABLE 1

| | | First ex. | Second ex. | Third ex. | Fourth ex. | Fifth ex. | Sixth ex. |
|---|---|---|---|---|---|---|---|
| Raw material fibers, etc. | Average fiber length (mm) | 0.114 | 0.085 | 0.251 | 0.019 | 0.984 | 0.210 |
| | Average fiber diameter (mm) | 0.021 | 0.037 | 0.098 | 0.004 | 0.052 | 0.003 |
| | Average fiber length/average fiber diameter | 5.4 | 2.3 | 2.6 | 4.8 | 18.9 | 70.0 |
| Metal fiber molded bodies, etc. | Presence ratio of metal fibers in cross-section P (first cross-section) | 0.672 | 0.651 | 0.635 | 0.411 | 0.487 | 0.512 |
| | Presence ratio of metal fibers in cross-section Q (second cross-section) | 0.626 | 0.730 | 0.687 | 0.480 | 0.456 | 0.446 |
| | Ratio of metal presence ratios | 0.931 | 1.121 | 0.924 | 0.856 | 1.068 | 1.147 |
| | Thickness (um) | 415 | 204 | 138 | 520 | 326 | 289 |
| | Basis weight (g/m$^2$) | 300 | 1000 | 840 | 1948 | 1427 | 1258 |
| | Space factor (%) | 65.0 | 60.6 | 68.4 | 42.1 | 49.2 | 48.9 |
| | Thermal conductivity (W/m · K) | 44.9 | 58.0 | 53.8 | 26.3 | 37.4 | 28.2 |
| | Elongation percentage | Excellent | Excellent | Excellent | Good | Excellent | Excellent |
| | CTE relaxation properties | Excellent | Excellent | Excellent | Good | Excellent | Excellent |
| | Air permeability | Excellent | Excellent | Excellent | Good | Excellent | Good |

TABLE 2

| | | First comp. ex. | Second comp. ex. | Third comp. ex. | Fourth comp. ex. | Fifth comp. ex. | Sixth comp. ex. | Seventh comp. ex. |
|---|---|---|---|---|---|---|---|---|
| Raw material fibers, etc. | Average fiber length (mm) | 2.875 | 0.040 | — | — | 0.178 | 0.019 | 0.210 |
| | Average fiber diameter (mm) | 0.019 | 0.040 | — | — | 0.126 | 0.004 | 0.003 |
| | Average fiber length/average fiber diameter | 151.3 | 1.0 | — | — | 1.4 | 4.8 | 70.0 |
| Metal fiber molded bodies, etc. | Presence ratio of metal fibers in cross-section P (first cross-section) | 0.363 | 0.759 | 0.725 | 1 | 0.310 | 0.345 | 0.520 |
| | Presence ratio of metal fibers in cross-section Q (second cross-section) | 0.225 | 0.804 | 0.756 | 1 | 0.371 | 0.596 | 0.382 |
| | Ratio of metal presence ratios | 0.620 | 1.060 | 1.043 | 1.000 | 0.836 | 0.579 | 1.362 |
| | Thickness (um) | 145 | 494 | 315 | 1004 | 752 | 513 | 296 |
| | Basis weight (g/m$^2$) | 229 | 3403 | 2066 | 8936 | 2503 | 1908 | 1307 |
| | Space factor (%) | 23.2 | 77.4 | 73.7 | 100.0 | 37.4 | 41.8 | 49.6 |
| | Thermal conductivity (W/m · K) | 3.7 | 62.5 | 42.8 | 102.5 | 6.9 | 13.8 | 14.6 |
| | Elongation percentage | Excellent | Poor | Poor | Poor | Poor | Excellent | Excellent |
| | CTE relaxation properties | Excellent | Poor | Poor | Poor | Poor | Excellent | Excellent |
| | Air permeability | Excellent | Fair | Fair | Poor | Excellent | Good | Good |

In Table 1, etc., the ratio of metal presence ratios refers to the ratio, to the presence ratio of the metal in the first cross-section, of the presence ratio of the metal in the second cross-section orthogonal to the first cross-section in each of the metal fiber molded bodies and the metal molded bodies, etc., according to the examples and the comparative examples. In addition, the space factor refers to the ratio of the metal in the unit volume of each of the metal fiber molded bodies and the metal molded bodies, etc., according to the examples and the comparative examples. Moreover, the thermal conductivity was measured as a thermal conductivity in the thickness direction (Z direction (up-down direction) in FIG. 18) of each of the metal fiber molded bodies, the metal molded bodies, etc., by the steady-state method using a steady method thermal conductivity measurement system (manufactured by ADVANCE RIKO, Inc.). Moreover, the elongation percentage was measured as an elongation percentage in the plane direction (X direction or Y direction in FIG. 18) of each of the metal fiber molded bodies, the metal molded bodies, etc., by a method conforming to ISO 6892-1: 2009, Metallic materials—Tensile testing—Part 1: Method of test at room temperature (MOD using a Tensilon universal material testing instrument (manufactured by A&D Company, Limited)). A test piece broken at an elongation amount of not less than 500 ppm was determined as excellent, a test piece broken at an elongation amount of less than 500 ppm and not less than 200 ppm was determined as good, and a test piece broken at an elongation amount of less than 200 ppm was determined as poor.

Moreover, for the CTE relaxation properties, each of the metal fiber molded bodies and the metal molded bodies, etc., according to the examples and the comparative examples was bonded to an object such as an alumina plate by an inorganic adhesive, and it was examined whether each of the metal fiber molded bodies, the metal molded bodies, etc., follows the expansion or contraction of the object when being heated or when being cooled. Specifically, the case where, even when the object such as an alumina plate to which one of the metal fiber molded bodies, the metal molded bodies, etc., was bonded expanded or contracted, no warpage, peeling, cracking, etc., occurred due to said one of the metal fiber molded bodies, the metal molded bodies, etc., following the expansion or contraction, was evaluated as "excellent" for CTE relaxation properties, and the case where slight warpage occurred but no peeling, cracking, etc., occurred was evaluated as "good" for CTE relaxation properties. On the other hand, the case where, when the object such as an alumina plate to which one of the metal fiber molded bodies, the metal molded bodies, etc., was bonded expanded or contracted, warpage, peeling, cracking, or the like occurred in said one of the metal fiber molded bodies, the metal molded bodies, etc., was evaluated as "fair" or "poor" for CTE relaxation properties. Moreover, for the air permeability, the time required for 100 cc of air to pass through each of the metal molded bodies, etc., was examined by a Gurley tester method (ISO 5636-5) using an air permeability tester that is a Gurley type densometer (manufactured by Toyo Seiki Seisaku-sho, Ltd.), and evaluation was made based on this passage time. The metal molded body or the like for which the passage time was less than 10 seconds was determined as excellent, the metal molded body or the like for which the passage time was not shorter than 10 seconds and shorter than 20 seconds was determined as good, the metal molded body or the like for which the passage time was not shorter than 20 seconds and shorter than 30 seconds was determined as fair, and the metal molded body or the like for which the passage time was not shorter than 30 seconds was determined as poor.

The metal fiber molded bodies according to the first to sixth examples had better thermal conductivities in the thickness direction (Z direction (up-down direction) in FIG. 18) than the metal fiber molded bodies according to the first and fifth to seventh comparative examples. In the metal fiber molded bodies according to the first and fifth to seventh comparative examples, the metal fibers are oriented mainly in the plane direction, so that the thermal conductivity along the plane where the metal fibers are oriented is excellent, but the thermal conductivity in the direction (that is, the thickness direction) orthogonal to the plane where the metal fibers are oriented is inferior. On the other hand, in the metal fiber molded bodies according to the first to sixth examples, the ratio, to the presence ratio of the metal in the first cross-section, of the presence ratio of the metal in the second cross-section orthogonal to the first cross-section is in the range of 0.85 to 1.15, and the metal fibers are oriented in both the plane direction and the thickness direction, so that the thermal conductivity in the direction (that is, the thickness direction) orthogonal to the plane where the metal fibers are oriented is excellent.

Moreover, the metal fiber molded bodies according to the first to sixth examples had better elongation percentages, CTE relaxation properties, and air permeability than the metal molded bodies, etc., according to the second to fourth comparative examples. The metal powder sintered body or metal bulk produced by sintering metal powder has inferior elasticity when the temperature changes, as compared to the metal fiber molded bodies. Therefore, when a heat-transfer object to which a temperature regulation unit including the metal powder sintered body or the metal bulk is attached expands or contracts, the temperature regulation unit cannot follow the expansion or contraction of the heat-transfer object, causing a problem that the temperature regulation unit becomes detached from the heat-transfer object or destroyed. On the other hand, the metal fiber molded bodies according to the first to sixth examples have excellent elongation percentages and CTE relaxation properties, and thus can inhibit such a problem from arising.

The invention claimed is:

1. A temperature regulation unit comprising:

a metal fiber molded body, wherein a ratio, to a presence ratio of metal fibers in a first cross-section, of a presence ratio of metal fibers in a second cross-section orthogonal to the first cross-section is in a range of 0.85 to 1.15, wherein the short metal fibers each have a length in a range of 0.01 to 1.00 mm, wherein the short metal fibers are at least one type of fibers out of copper fibers, stainless steel fibers, nickel fibers, aluminum fibers, and alloy fibers thereof, and wherein the short metal fibers have a space factor in a range of 42.1 to 68.4%; and a support supporting the metal fiber molded body.

2. The temperature regulation unit according to claim 1, wherein the metal fiber molded body is produced by sintering a plurality of short metal fibers accumulated on a receiving part.

3. The temperature regulation unit according to claim 1, wherein the metal fiber molded body has a columnar shape, and a plurality of the metal fiber molded bodies are arranged on intersection points of grid lines, respectively.

4. The temperature regulation unit according to claim 1, wherein voids are formed between the plurality of the metal fiber molded bodies.

5. The temperature regulation unit according to claim 1, wherein the support includes a pipe, the metal fiber molded body having a plate shape is wrapped around an outer circumferential surface of the pipe in a bent state, and the metal fiber molded body having a fin shape is attached to the bent metal fiber molded body having a plate shape.

6. A method for manufacturing the metal fiber molded body of the temperature regulation unit according to claim 1, the method comprising the steps of:

accumulating a plurality of short metal fibers on a receiving part; and sintering the plurality of short metal fibers accumulated on the receiving part, to produce the metal fiber molded body.

7. The method according to claim 6, further comprising the step of physically impacting the short metal fibers to deform the short metal fibers, before the step of accumulating the plurality of short metal fibers on the receiving part.

8. The method according to claim 6, wherein, in the step of physically impacting the short metal fibers to deform the short metal fibers, the short metal fibers are physically impacted by shearing the short metal fibers with a rotary body rotating about a shaft.

9. The method according to claim 6, wherein, in the step of accumulating the plurality of short metal fibers on the receiving part, a molding frame having a through hole formed therein is placed on the receiving part, and the plurality of short metal fibers are accommodated inside the through hole of the molding frame placed on the receiving part.

* * * * *